US007665155B2

(12) United States Patent
Grilliot et al.

(10) Patent No.: US 7,665,155 B2
(45) Date of Patent: Feb. 23, 2010

(54) ROLLED EDGE POCKET FLAP

(75) Inventors: William L. Grilliot, Dayton, OH (US); Mary I. Grilliot, Dayton, OH (US); Patricia K. Waters, Tipp City, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 11/788,175

(22) Filed: Apr. 19, 2007

(65) Prior Publication Data

US 2008/0256689 A1 Oct. 23, 2008

(51) Int. Cl.
*A41D 27/20* (2006.01)
*A62B 17/00* (2006.01)

(52) U.S. Cl. ..... 2/252; 2/247; 2/81

(58) Field of Classification Search ..... 2/252, 2/248, 250, 256, 920, 247, 257, 258, 81; 224/236, 237; 190/902; 150/143, 152
See application file for complete search history.

(56) References Cited

U.S. PATENT DOCUMENTS 204,199 A * 5/1878 Chow ..... 2/248
3,051,130 A * 8/1962 Morris ..... 224/183
6,189,153 B1 * 2/2001 Diamond ..... 2/247

* cited by examiner

*Primary Examiner*—Gary L Welch
*Assistant Examiner*—Amber R Anderson
(74) *Attorney, Agent, or Firm*—Wood, Phillips, Katz, Clark & Mortimer

(57) ABSTRACT

A closure for use with a pocket for a protective garment is provided. The closure includes a margin, a closure body and an edge. The edge is thicker than the closure body so as to provide better tactile feedback for the wearer. The edge may also include an insert located within the edge.

20 Claims, 1 Drawing Sheet

10
12
14
22
22
20
20
22
16
12

30
34
20
32
16
28
40
3
52
36
42
38
24
3

32
30
52
28
34
36
42
54
56
12
40
50
26
38
24

T3
36
38
A
40
42
A

T1
40
36
30
A
38
42
T4
A

T2
30
36
B
40
50
38
42
A

ROLLED EDGE POCKET FLAP

TECHNICAL FIELD

This invention pertains to a protective garment such as for a firefighter or emergency worker, and in more particular applications, to a protective garment having a pocket with a closure.

BACKGROUND OF THE INVENTION

Commonly, a firefighter or an emergency worker wears a protective garment, such as a protective coat or protective coveralls, onto which is sewn an external pouch or pocket for holding a variety of items, such as ropes, telecommunications devices and other objects. Additionally, the protective garment is often manufactured to protect the wearer from heat, flames, water, abrasion and other environmental factors. Such protective garments are often multi-layered and manufactured from such materials as Nomex® and Kevlar®.

Furthermore, firefighters and emergency workers often wear gloves which can be thick, thereby providing diminished tactile feedback. In this regard, while wearing gloves, the firefighter or emergency worker may have a difficult time opening pockets, especially when attempting to open the pocket based on tactile feedback. For example, the firefighter or emergency worker may be preoccupied with carrying equipment or rescuing an individual and may need to access items located within a pocket. The firefighter or emergency worker may try to feel for the closure on the pocket, but have a difficult time because of the thickness of the gloves he or she is wearing. Therefore, it is desired to improve the tactile feedback of the pocket and/or closure on the pocket.

SUMMARY OF THE INVENTION

In one form, a closure for use with a pocket for a protective garment for a firefighter or emergency worker is provided. The closure includes a margin, a closure body an edge and an insert. The margin is used for attaching the closure to the protective garment. The closure body is made from a fabric material having a thickness and extends from the margin. The edge extends outwardly from the closure body and is made from the same fabric material as the closure body. The edge includes an inner layer and an outer layer. The insert is located between the inner and outer layers and has a thickness greater than thickness of the closure body.

According to one form, a closure for use with a pocket for a protective garment for a firefighter or emergency worker is provided. The closure includes a margin, a closure body and an edge. The margin is used for attaching the closure to the protective garment. The closure body is made from a fabric material, extends from the margin and has a substantially flat cross-sectional shape. The edge extends outwardly from the closure body and is made from the same fabric material as the closure body. The edge has a circular or oval cross-sectional shape.

In one form, a closure for use with a pocket for a protective garment for a firefighter or emergency worker is provided. The closure includes a margin, a closure body and an edge. The margin is used for attaching the closure to the protective garment. The closure body is made from a fabric material, extends from the margin and has a first thickness. The edge extends outwardly from the closure body and is made from the same fabric material as the closure body. The edge has a second thickness that is at least five times the first thickness.

According to one form, the edge includes an inner, an outer layer and an insert located between the inner and outer layers.

In one form, the insert is made of a fire resistant material.

According to one form, the insert is a rope having a circular cross-sectional shape.

In one form, the edge has a length and the insert extends substantially the entire length of the edge.

According to one form, the edge is substantially straight.

In one form, the closure further includes a fastener to releasably secure the closure to the pocket.

Other objects, features, and advantages of the invention will become apparent from a review of the entire specification, including the appended claims and drawings.

DETAILED DESCRIPTION OF THE ILLUSTRATED EMBODIMENT

Figure 1:
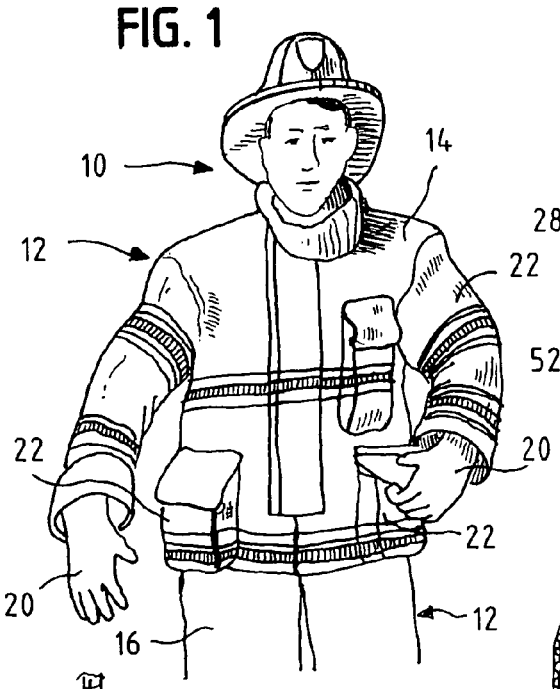
FIG. 1 is a front view of a firefighter wearing a protective jacket including multiple pockets.

As illustrated in FIG. 1, a firefighter 10 is shown wearing a protective garment 12. More specifically, the firefighter 10 is wearing two protective garments 12, a jacket 14 and coveralls or pants 16. Except as described herein, the garment 12 may be substantially similar to prior garments designed for firefighters and rescue workers, such as those manufactured and sold by Morning Pride Manufacturing, Inc. of Dayton, Ohio. Additionally, the general design and construction of such garments 12 is well known by those skilled in the art. Furthermore, the firefighter 10 is also shown wearing gloves 20.

Figure 2:
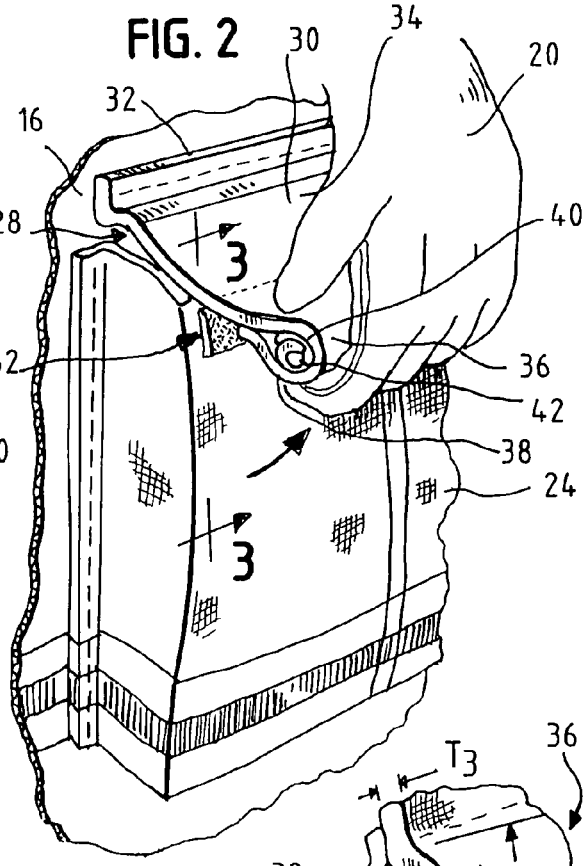
FIG. 2 is perspective view of a pocket and a closure located on a protective garment.

Referring to FIG. 1, the jacket 14 includes three pockets 22. However, it should be understood that any number of pockets 22 may be used. Furthermore, the pockets 22 may be located on a variety of protective garments, such as pants 16, as illustrated in FIG. 2. Additionally, the pockets 22 may be located on the protective garment 12 having any desired orientation.

In one form, the pocket 22 includes a main body portion 24 which is affixed to the protective garment 12. In this form, the main body portion defines an interior space 26. The pocket 22 further includes a mouth 28 whereby a user can access the interior space 26. While the embodiment illustrated in FIG. 2 is shown as affixed to the exterior of the protective garment 12, it should be understood that the pocket 22 may be located within the protective garment 12 such that mouth 28 is located on the exterior of the protective garment 12.

Furthermore, the pocket 22 is shown in FIG. 2 as having a generally rectangular shape. It should be understood by those skilled in the art that the pocket may have any desired shape, such as a circular or other shape.

Figure 6:
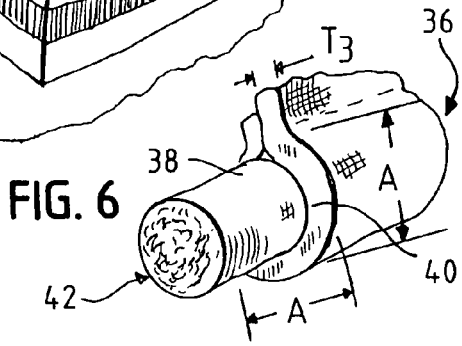
FIG. 6 is a partial cutaway perspective view of a closure and yet another embodiment of an insert.
Figure 4:
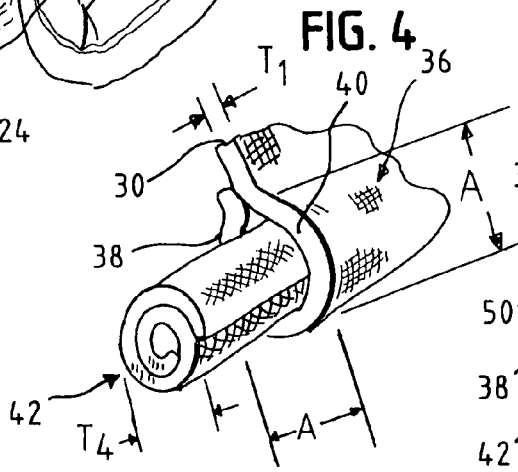
FIG. 4 is a partial cutaway perspective view of a closure and one embodiment of an insert.

The pocket 22 also includes a closure 30 to at least substantially cover the mouth 28. The closure 30 includes a margin 32 for fixedly attaching the closure 30 to the protective garment 12. The closure 30 has a body 34 having a thickness, as illustrated by T1, T2 and T3 in FIGS. 4-6. The closure 30 further includes an edge 36 extending outwardly from the body 34. In one form, the edge 36 is made from the same material as the body 34. More particularly, in one form, the edge 36 is an extended portion of the body 34 which has been folded over to create the edge 36. In this form, the edge 36 includes an inner layer 38 and an outer layer 40.

As shown in the drawings, there is a single sheet that defines the closure body 34 and is folded against itself to define the inner and outer layers 38,40.

Furthermore, in one form, the edge 36 further includes an insert 42 located between the inner layer 38 and the outer layer 40. The insert 42 has a thickness T4 that is greater than the thickness T1, T2, T3 of the closure body 34. In one form, the edge 36 has a thickness represented by element A that is at least five times the thickness T1, T2, T3 of the body.

The insert 42 may be made from a variety of materials as desired. For example, for firefighters, the insert may be made of Kevlar® or other fire resistant material. Additionally, the insert 42 may have a length that extends the entire length of the edge 36. Alternatively, the insert 42 may extend only partially along the length of the edge 36 and/or multiple inserts 42 may be used along the length of the edge 36. Furthermore, the insert 42 may take a variety of forms such as a rope 44, a rolled material 46 or other suitable forms understood by those skilled in the art. The insert 42 has a rounded share at the bottom thereof around which the sheet defining the inner and outer layers 38,40 is wrapped and to which the sheet is conformed at the edge 36.

Figure 5:
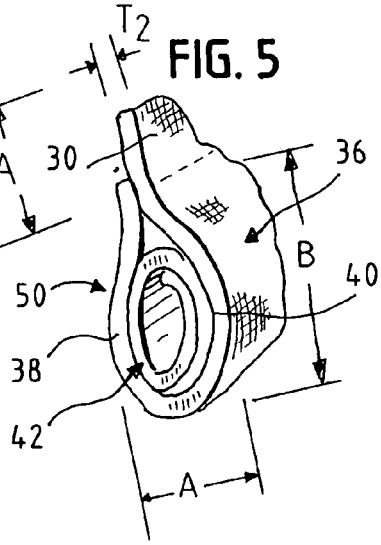
FIG. 5 is a partial cutaway perspective view of a closure and another embodiment of an insert.

Similarly, the shape of the insert 42 may be varied as well. For example, in FIG. 6, the insert 42 has a substantially circular cross-sectional shape whereas in FIG. 5, the insert 42 has a substantially oval cross-sectional shape. Consequently, the edge 36 may take a variety of shapes. For example, in FIGS. 4 and 6, the insert 42 has a circular cross-sectional shape and therefore, the edge 36 has a generally circular cross-sectional shape as shown by the dimensions represented by element A. Alternatively, the edge 36 may have a generally oval cross-sectional shape as shown in FIG. 5 by the dimensions represented by elements A and B where dimension B is larger than dimension A.

While the embodiments illustrated in the figures depict an end 50 of the edge 36 exposed, it should be understood that the end 50 may be closed such that the insert 42 is enclosed within the edge 36.

Figure 3:
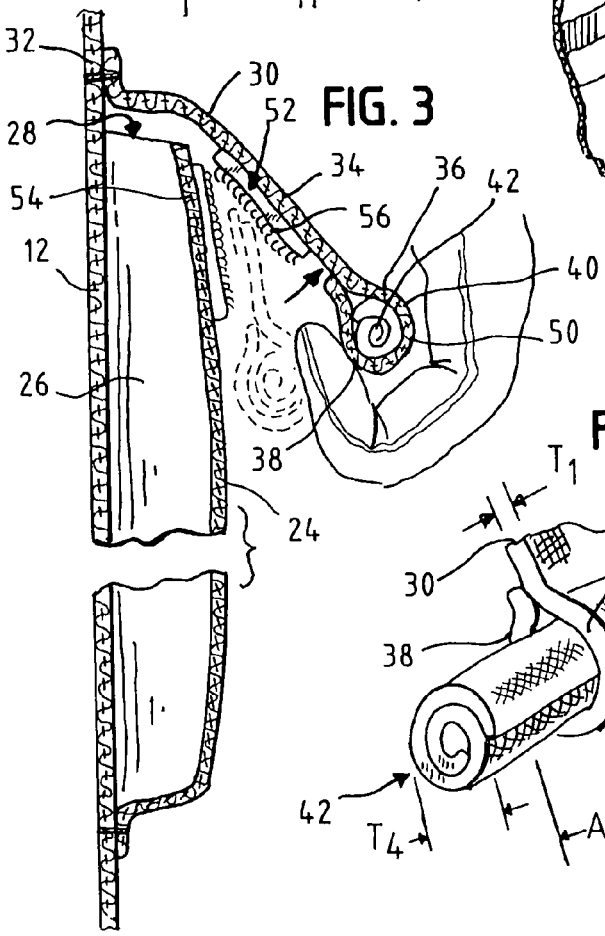
FIG. 3 is a cross-sectional view of the pocket and closure of FIG. 2.

In one embodiment, the pocket 22 is openable and closable, and when opened, provides access to the pocket 22. The closure 30 is selectively manually movable between a first position wherein the pocket 22 is open and the mouth 28 is accessible, and a second position wherein the pocket 22 is substantially closed. The closure 30 can be releasably maintained in the second position via the use of fasteners 52. One such suitable fastener is illustrated in FIG. 3 as a hook and loop type fastener. The hook and loop fastener has a portion 54 of the fastener 52 located on the pocket 22 and a portion 56 of the fastener 52 located on the closure 30. It should be understood that other fasteners may also be used, such as snaps, buttons, zippers and the like.

The pocket 22, as well as the closure 30 may be made from a variety of materials. In one embodiment, the pocket 22 and the closure 30 are made from the same material as the exterior of the garment 12. These materials are well known by those skilled in the art and may include materials having thermal, abrasion and/or water resistance.

The pocket 22 may be assembled prior to being affixed to the garment 12. Alternatively, the pocket 22 may be assembled while it is affixed to the garment 12. Furthermore, the pocket 22 may be affixed to the garment prior to, during and/or after the garment 12 is assembled. The pocket 22 may be affixed to the garment in a variety of manners such as sewing, riveting and other methods known to those skilled in the art. Additionally, the pocket 22 and closure 30 may be releasably affixed to the garment 12 such that the pocket 22 and closure 30 may be removed from the garment 12. In this manner, the pocket 22 and closure 30 may be affixed to the garment 12 via hook and loop fasteners (not shown) similar to the hook and loop fastener described above.

It should be appreciated that for all of the disclosed embodiments there are many possible modifications. Additionally, it should be understood that the embodiments described herein may be utilized with a variety of garments, such as jackets, shirts, pants, shorts, and other garments.

The invention claimed is:

1. A closure for selectively covering a pocket mouth on a protective garment for a firefighter or emergency worker, the closure cormprising:

a margin through which the closure is fixedly attached to the protective garment;

a closure body made from a fabric material having a thickness and extending from the margin;

an edge extending outwardly from the closure body, the edge including an inner layer and an outer layer and comprising a single sheet that defines the closure body and is folded against itself to define the inner and outer layers; and an insert located between the inner and outer layers, the insert having a thickness greater than the thickness of the closure body and a generally rounded shape at a bottom of the insert, the sheet wrapped around and generally conformed to the rounded shape at the bottom of the insert.

2. The closure of claim 1 wherein the insert is made of a fire resistant material.

3. The closure of claim 1 wherein the insert is a rope having a circular cross-sectional shape.

4. The closure of claim 1 wherein the edge has a length and the insert and the rounded shape at the bottom of the insert extend substantially the entire length of the edge.

5. The closure of claim 1 wherein the edge is substantially straight.

6. The closure of claim 1 further comprising a fastener to releasably secure the closure to the pocket.

7. A closure for selectively covering a pocket mouth on a protective garment for a firefighter or emergency worker, the closure comprising:

a margin through which the closure is fixedly attached to the protective garment;

a closure body made from a fabric material extending from the margin and having a substantially flat cross-sectional shape;

an insert with a rounded bottom; and an edge extending outwardly from the closure body and being made from the same fabric material as the closure body, the edge defined by the fabric material that is wrapped around and generally conformed to the rounded bottom of the insert, the fabric material in the form of a sheet that defines the body and the edge.

8. The closure of claim 7 wherein the edge includes an inner, an outer layer and the insert is located between the inner and outer layers.

9. The closure of claim 8 wherein the insert is made of a fire resistant material.

10. The closure of claim 8 wherein the insert is a rope having a circular cross-sectional shape.

11. The closure of claim 8 wherein the edge has a length and the insert and the rounded shape at the bottom of the insert extend substantially the entire length of the edge.

12. The closure of claim 7 wherein the edge is substantially straight.

13. The closure of claim 7 further comprising a fastener to releasably secure the closure to the pocket.

14. A closure for use with a pocket for a protective garment for a firefighter or emergency worker to selectively cover a pocket mouth, the closure comprising:

a margin for fixedly attaching the closure to the protective garment;

a closure body made from a fabric material extending from the margin and having a first thickness;

an insert with a rounded bottom; and an edge extending outwardly from the closure body, the edge having a second thickness that is at least five times the first thickness defined by a single continuous extension of the fabric material that is wrapped around and Generally conformed to the rounded bottom of the insert.

15. The closure of claim 14 wherein the edge includes an inner, an outer layer and the insert is located between the inner and outer layers.

16. The closure of claim 15 wherein the insert is made of a fire resistant material.

17. The closure of claim 15 wherein the insert is a rope having a circular cross-sectional shape.

18. The closure of claim 15 wherein the edge has a length and the insert and the rounded share at the bottom of the insert extend substantially the entire length of the edge.

19. The closure of claim 14 wherein the edge is substantially straight.

20. The closure of claim 14 further comprising a fastener to releasably secure the closure to the pocket.

* * * * *